US006701822B2

(12) United States Patent
Hajek, Jr. et al.

(10) Patent No.: US 6,701,822 B2
(45) Date of Patent: Mar. 9, 2004

(54) INDEPENDENT AND REGENERATIVE MODE FLUID CONTROL SYSTEM

(75) Inventors: Thomas J. Hajek, Jr., Lockport, IL (US); Srikrishnan T. Tolappa, deceased, late of Aurora, IL (US), by Rangamani Srikrishnan, legal representative; James D. Linderode, Bolingbrook, IL (US)

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 0 days.

(21) Appl. No.: 10/244,074

(22) Filed: Sep. 16, 2002

(65) Prior Publication Data

US 2003/0106422 A1 Jun. 12, 2003

Related U.S. Application Data

(60) Provisional application No. 60/328,430, filed on Oct. 12, 2001.

(51) Int. Cl.[7] ..... F15B 11/00
(52) U.S. Cl. ..... 91/178; 91/454
(58) Field of Search ..... 91/454, 508, 6, 91/32, 178; 60/414

(56) References Cited

U.S. PATENT DOCUMENTS

| | | | |
|---|---|---|---|
| 3,187,637 | A | 6/1965 | Edmund |
| 3,960,059 | A | 6/1976 | Schexnayder |
| 4,033,129 | A | 7/1977 | Hetzler et al. |
| 4,149,565 | A | 4/1979 | Jennings et al. |
| 4,263,746 | A | 4/1981 | Eller et al. |
| 4,473,090 | A | 9/1984 | Uehara et al. |
| 4,610,193 | A | 9/1986 | Barker et al. |
| 4,611,527 | A | 9/1986 | Breeden |
| 4,690,035 | A | 9/1987 | Bouteille et al. |
| 4,702,148 | A | 10/1987 | Kussel et al. |
| 4,809,586 | A | 3/1989 | Gage et al. |
| 4,833,798 | A | 5/1989 | Ehrich |
| 4,967,557 | A | 11/1990 | Izumi et al. |
| 5,046,309 | A | 9/1991 | Yoshino |
| 5,065,844 | A | 11/1991 | Hon |
| 5,220,862 | A | 6/1993 | Schexnayder |
| 5,370,038 | A | 12/1994 | Poppe et al. |
| 5,473,970 | A | 12/1995 | Hayashi et al. |
| 5,862,831 | A | 1/1999 | Chung et al. |
| 5,868,059 | A | 2/1999 | Smith |
| 5,927,520 | A | 7/1999 | Barthalow et al. |
| 6,155,282 | A | 12/2000 | Zachary et al. |
| 6,161,467 | A | 12/2000 | A'Hearn et al. |
| 6,164,327 | A | 12/2000 | Yoshida |
| 6,186,044 | B1 | 2/2001 | Hajek, Jr. et al. |

*Primary Examiner*—Edward K. Look
*Assistant Examiner*—Michael Leslie
(74) *Attorney, Agent, or Firm*—Finnegan, Henderson, Farabow, Garrett & Dunner

(57) ABSTRACT

A fluid control system is disclosed that includes a first double-acting actuator and a second double-acting actuator. A first independent metering valve has a first control port connected to the first double-acting actuator, a second control port connected to the second double-acting actuator, first and second independently operable valves disposed between the inlet port and the first and second control ports, and a first check control mechanism having a main check valve between the inlet port and the first and second independently operable valves. The first check control mechanism controls the main check valve to allow the first and second actuators to operate in either an independent function mode or a regenerative function mode. A second independent metering valve has a first control port connected to the first double-acting actuator, a second control port connected to the second double-acting actuator, first and second independently operable valves disposed between the inlet port and the first and second control ports, and a main check valve disposed between the inlet port and the first and second independently operable valves.

15 Claims, 2 Drawing Sheets

INDEPENDENT AND REGENERATIVE MODE FLUID CONTROL SYSTEM

This application claims the benefit of U.S. Provisional Application Ser. No. 60/328,430 entitled "Independent and Regenerative Mode Fluid Control System," filed Oct. 12, 2001.

TECHNICAL FIELD

This invention relates to a fluid control system for operating actuators. More particularly, the invention is directed to a fluid control system for operating multiple actuators in independent and regenerative function modes.

BACKGROUND

Some fluid control systems operate a double-acting actuator with a regeneration capability. The fluid control systems with this regeneration capability direct some of the fluid exhausted from a contracting chamber of a double-acting actuator to an expanding chamber of the actuator.

In the past, a regeneration valve is disposed between a main directional control valve and an actuator to provide a quick drop capability to the actuator driven in one direction by gravity loads. In such a configuration, however, an operator has little or no control over the amount of regenerated fluid recirculated from the contracting chamber to the expanding chamber.

A fluid control system with a relatively simple regeneration capability has been provided in association with a pump, a tank, and a double-acting actuator having a pair of actuating chambers. For example, U.S. Pat. No. 6,161,467 discloses a fluid control system having a regeneration capability. The system includes a pump, a tank, two double-acting actuators having actuating chambers, and a control valve. The control valve moves from a first position to a second position in a regeneration mode. This fluid control system, however, does not allow operation of the multiple actuators both regeneratively and independently. It is desirable to provide a fluid control system that provides accurate control of the actuators and is compact in size.

Accordingly, the present invention is directed to overcoming one or more of the problems as set forth above.

SUMMARY OF THE INVENTION

In one aspect of the invention, a fluid control system includes a first double-acting actuator and a second double-acting actuator. A first independent metering valve has a first control port connected to the first double-acting actuator, a second control port connected to the second double-acting actuator, first and second independently operable valves disposed between the inlet port and the first and second control ports, and a first check control mechanism having a main check valve between the inlet port and the first and second independently operable valves. The first check control mechanism controls the main check valve to allow the first and second actuators to operate in either an independent function mode or a regenerative function mode. A second independent metering valve has a first control port connected to the first double-acting actuator, a second control port connected to the second double-acting actuator, first and second independently operable valves disposed between the inlet port and the first and second control ports, and a main check valve disposed between the inlet port and the first and second independently operable valves.

In another aspect of the invention, a method is provided to control fluid flow to and from first and second double-acting actuators in an independent function mode and a regenerative function mode. The method includes providing a first independent metering valve having a first check control mechanism in fluid communication with the first and second double-acting actuators, providing a second independent metering valve having a main check valve in fluid communication with the first and second double-acting actuator, and operating the first control check control mechanism to allow the first and second actuators to selectively operate in independent and regenerative function modes.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention.

DETAILED DESCRIPTION

Reference will now be made in detail to the present preferred embodiments of the invention, examples of which are illustrated in the accompanying drawings. Wherever possible, the same reference numbers will be used throughout the drawings to refer to the same or like parts.

Figure 1:
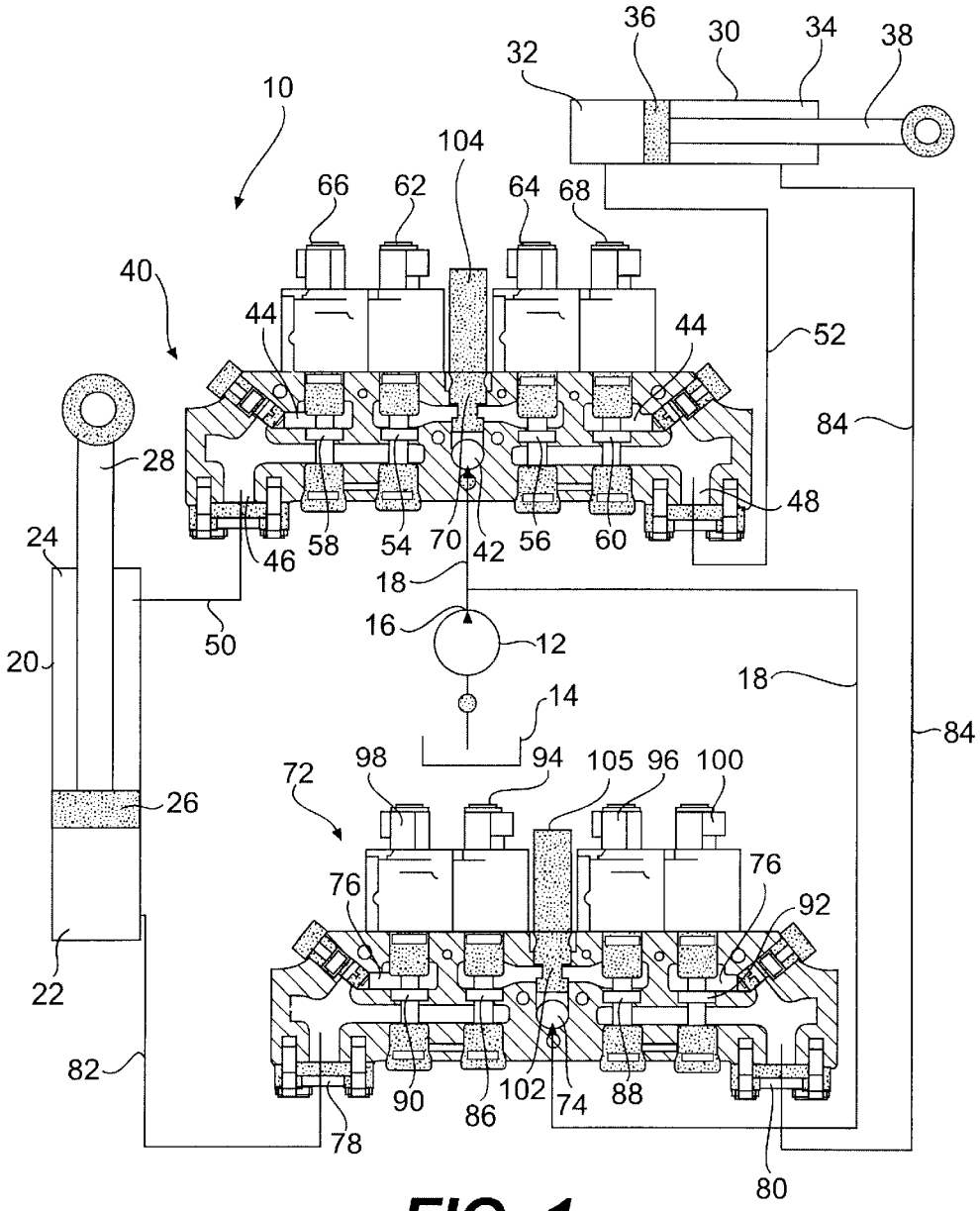
FIG. 1 is a schematic and diagrammatic representation of a fluid control system according to one embodiment of the present invention.

FIG. 1 illustrates one embodiment of the fluid control system of the present invention having regenerative and independent function modes. The fluid control system 10 has a pump 12 and a reservoir 14 in fluid communication with the pump 12. The pump 12 is typically driven by a motor (not shown in the figure), such as an engine, and receives fluid from the reservoir 14. The pump 12 has a pump outlet port 16 connected to a supply conduit 18.

In one exemplary embodiment, the fluid control system 10 includes a first double-acting actuator 20. The first double-acting actuator 20 has a pair of actuating chambers, namely a head end actuating chamber 22 and a rod end actuating chamber 24. The head end chamber 22 and the rod end chamber 24 are separated by a piston 26 having a piston rod 28. The double-acting actuator 20 may be a hydraulic cylinder or any other suitable implement device used for raising, lowering, or tilting parts of a machine, such as an excavator or a track loader.

The fluid control system 10 has a second double-acting actuator 30. Similar to the first actuator 20, the second double-acting actuator 30 has a head end chamber 32 and a rod end chamber 34 separated by a piston 36. A piston rod 38 is connected to the piston 36. The second double-acting actuator 30 may also be a hydraulic cylinder or any other suitable implement device.

The fluid control system 10 includes a first independent metering valve (IMV) 40. As shown in FIG. 1, the first IMV 40 has an inlet port 42 and two outlet ports 44. The inlet port 42 is connected to the pump 12 via the supply conduit 18 and receives the pressurized fluid from the pump. The outlet ports 44 may be connected to a reservoir (the connection is not shown in the figure) to discharge fluid out of the first IMV 40. In one embodiment, this reservoir may be the reservoir 14 connected to the pump 12.

The first IMV 40 also has first and second control ports 46, 48, respectively. The first control port 46 is connected to the rod end chamber 24 of the first double-acting actuator 20 by a conduit 50. The second control port 48 is connected to the head end chamber 32 of the second double-acting actuator 30 by a conduit 52.

The first IMV 40 has four independently operable valves. A first independently operable valve 54 is disposed between the inlet port 42 and the first control port 46, and a second independently operable valve 56 is disposed between the inlet port 42 and the second control port 48. A third independently operable valve 58 is disposed between the outlet port 44 and the first control port 46, and a fourth independently operable valve 60 is disposed between the outlet port 44 and the second control port 48. In one exemplary embodiment, these independently operable valves are proportional valves that can vary fluid flow through the valves based on load requirements. Each of the valves may be equipped with a spring (not shown) to keep the valves in a closed position when the valves are not activated.

The first IMV 40 has solenoid 62 coupled to the first independently operable valve 54 to operate the valve when the solenoid is energized. A second solenoid 64, a third solenoid 66, and a fourth solenoid 68 are coupled to the second, third, and fourth independently operable valves 56, 58, 60, respectively, to operate the valves in a similar fashion. These solenoids are energized by a control unit (not shown) to selectively open and close the independently operable valves.

The first IMV 40 includes a main check valve 70 between the inlet port 42 and the first and second independently operable valves 54, 56. The main check valve 70 may be located near the inlet port 42 and may be biased toward a closed position by a spring (not shown in FIG. 1). When the pump 14 supplies the main check valve with sufficient fluid pressure via the supply conduit 18 and the inlet port 42, the main check valve 70 is pushed open by the fluid pressure and the fluid from the pump 12 flows through the check valve 70 to the first and second valves 54, 56 of the first IMV 40.

The fluid control system 10 also includes a second independent metering valve (IMV) 72. In an exemplary embodiment, the second IMV 72 is located parallel to the first IMV 40 so that the overall size of the fluid control system 10 can be minimized. The structure of the second IMV 72 may be similar to the first IMV 40. As shown in FIG. 1, the second IMV 40 has an inlet port 74 and two outlet ports 76. The inlet port 74 is connected to the pump 12 via the supply conduit 18 and receives the pressurized fluid from the pump. FIG. 1 illustrates the supply conduit 18 branched into two conduits to supply the pressurized fluid to the inlet port 74 of the second IMV 72 and the inlet port 42 of the first IMV 40. The outlet ports 76 may be connected to a reservoir (the connection is not shown in the figure) to discharge the fluid out of the second IMV 72. This reservoir may be the same reservoir 14 that is connected to the pump 12.

The second IMV 72 also has first and second control ports 78, 80, respectively. The first control port 78 is connected to the head end chamber 22 of the first double-acting actuator 20 by a conduit 82. The second control port 80 is connected to the rod end chamber 34 of the second double-acting actuator 30 by a conduit 84.

As illustrated in FIG. 1, the second IMV 72 has four independently operable valves, namely first, second, third and fourth independently operable valves 86, 88, 90, 92, respectively. The first independently operable valve 86 is disposed between the inlet port 74 and the first control port 78, and the second independently operable valve 88 is disposed between the inlet port 74 and the second control port 80. The third independently operable valve 90 is disposed between the outlet port 76 and the first control port 78. The fourth independently operable valve 92 is disposed between the outlet port 76 and the second control port 80. In one exemplary embodiment, these independently operable valves are proportional valves that can vary fluid flow through the valves based on load requirements. Each of the valves may be equipped with a spring (not shown) to keep the valves in a closed position when the valves are not activated.

Similar to the first IMV 40, the second IMV 72 also has a first solenoid 94 coupled to the first independently operable valve 86 to operate the valve when the solenoid is energized. A second solenoid 96, a third solenoid 98, and a fourth solenoid 100 are coupled to the second, third, and fourth independently operable valves 88, 90, 92, respectively, to operate the valves.

These solenoids are energized by a control unit (not shown) to selectively open and close the independently operable valves.

The second IMV 72 includes a main check valve 102 between the inlet port 74 and the first and second independently operable valves 86, 88. The main check valve 102 may be located near the inlet port 74 and may be biased toward a closed position by a spring (not shown in FIG. 1). When the pump 14 supplies the main check valve 102 with sufficient fluid pressure via the supply conduit 18 and the inlet port 74, the main check valve 102 is opened by the fluid pressure and the fluid flows through the main check valve 102 to the first and second valves 86, 88 of the second IMV 72.

Figure 2:
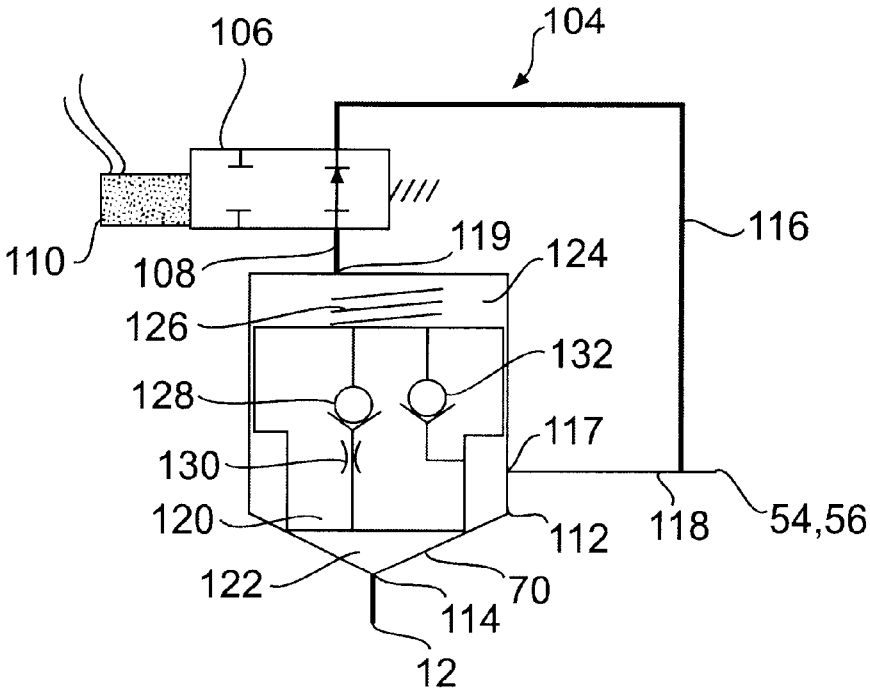
FIG. 2 is a schematic and diagrammatic representation of an embodiment of a check mechanism for the fluid control system of FIG. 1.

As shown in FIG. 1, the first IMV 40 has a first check control mechanism 104 to control the main check valve 70. FIG. 2 illustrates one embodiment of the first check control mechanism 104. As shown in FIG. 2, the first check control mechanism 104 has a proportional valve 106 coupled to the main check valve 70 via a conduit 108. The proportional valve 106 can be either normally opened or closed and can be actuated to close or open by energizing a solenoid 110 associated with the proportional valve 106. A normally opened proportional valve is illustrated in FIG. 2. The proportional valve 106 is connected to the first and second independently operable valves 54, 56 via a conduit 116.

The main check valve 70 includes a body 112 having an inlet port 114 and two outlet ports, namely a first outlet port 117 and a second outlet port 119. The inlet port 114 is in communication with the pump 12 via the supply conduit 18 and the inlet port 42. The first outlet port 117 is connected to the first and second independently operable valves 54, 56 via a conduit 118, and the second outlet port 119 is connected to the proportional valve 106 via the conduit 108. The main check valve 70 also has a valve element 120 slidably positioned within the body 112. A pump side chamber 122 is formed at the pump side of the valve element 120 and a proportional valve side chamber 124 is formed at proportional valve side. The pump side chamber 122 is in fluid communication with the inlet port 42 of the first IMV 40. The valve element 120 is movable between a closed position where the inlet port 114 is blocked from communication with the first outlet port 117 (See FIG. 2) and an open position where the first outlet port 117 is in communication with the inlet port 114. A spring 126 is provided within the proportional valve side chamber 124 and biases the valve element 120 to the closed position. The valve element 120 can be moved to the open position when the fluid pressure in the pump side chamber 122 overcomes the fluid pressure in the proportional valve side chamber 124 and the force of the spring 126. The valve element 120 is moved to the closed position when the spring bias force and the force due to the fluid pressure in the proportional valve side chamber 124 become greater than the force due to the fluid pressure in the pump side chamber 122.

As shown in FIG. 2, the valve element 120 has a first check valve 128 and a control orifice 130 disposed in communication with the pump side chamber 122 and the proportional valve side chamber 124. The valve element 120 also has a second check valve 132 that connects the proportional valve side chamber 124 and the first outlet port 117. In this configuration, the fluid pressure in the proportional valve side chamber 124 is equal to the higher of the fluid pressure in the pump side chamber 122 or at the first outlet 117.

Figure 3:
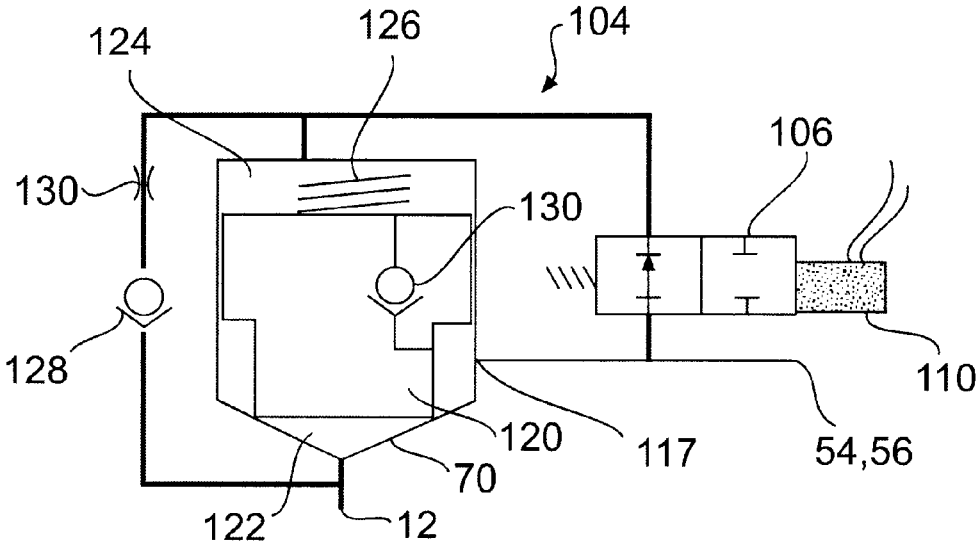
FIG. 3 is a schematic and diagrammatic representation of another embodiment of a check mechanism for the fluid control system of FIG. 1.

FIG. 3 illustrates another embodiment of the check control mechanism 104. The check control mechanism 104 in FIG. 3 has the main check valve 70 and the proportional valve 106 actuated by the solenoid 110. Unlike the check control mechanism shown in FIG. 2, however, the check control mechanism in FIG. 3 has the first check valve 128 and the control orifice 130 externally, i.e., not in the valve element 120. The check valve 128 and the control orifice 130 are disposed in communication with the pump side chamber 122 and the proportional valve side chamber 124. The relative positions of the check valve 128 and the control orifice 130 may be reversed. In this embodiment, the valve element 120 has the second check valve 132 that connects the proportional valve side chamber 124 and the first outlet port 117.

In FIG. 1, the second IMV 72 has a second check control mechanism 105, which is similar to the check control mechanism 104 for the first IMV 40. In another embodiment, however, the fluid control system 10 may not be equipped with the second check control system 105.

Industrial Applicability

The operation of the fluid control system 10 as illustrated in FIG. 1 is described hereafter. When the pump 12 is operated, pressurized fluid flows from the pump 12 to the inlet port 42 of the first IMV 40 and the inlet port 74 of the second IMV 72 via the split conduit 18. The pressurized fluid is applied to the pump side chamber 122 of the first check control mechanism 104 of the first IMV 40 and the second check control mechanism 105 of the second IMV 72.

The valve element 120 of the check control mechanism 104 is initially in the closed position, wherein the inlet port 114 is blocked from communication with the first outlet port 117. When the fluid pressure from the pump 12 is sufficiently small, the spring 126 maintains the valve element 120 in the closed position. When the valve element 120 is in the closed position, the fluid in the pump side chamber 122 travels through the check valve 128 and the control orifice 130 to the proportional valve side chamber 124.

When the fluid control system 10 is in the independent function mode, the proportional valve 106 of the check control mechanism 104 is in the open position. Once the pressure in the pump side chamber 122 overcomes the fluid pressure in the proportional valve side chamber 124 and the bias force of the spring 126, and the proportional valve 106 is open, the fluid pressure in the pump side chamber 122 moves the valve element 120 to the open position where the inlet port 114 is in fluid communication with the first outlet port 117. Thus, the fluid from the pump 12 flows through the first check control mechanism 104 to the first and second independently operable valves 54, 56 of the first IMV 40. Similarly, the fluid from the pump 12 flows through the second check control mechanism 105 to the first and second independently operable valves 86, 88 of the second IMV 72 when the valve element 120 of the second check control mechanism 105 opens.

To pressurize the head end chamber 22 of the first double-acting actuator 20, the first valve 86 of the second IMV 72 is selectively opened and the third valve 90 is closed. The pressurized fluid from the pump 12 then flows through the second IMV 72 to the head end chamber 22 of the first double-acting actuator 20, and the piston 26 and the piston rod 28 move in the upward direction according to the orientation in FIG. 1. At the same time, the fluid in the rod end chamber 24 of the first actuator 20 flows to the first IMV 40 through the conduit 50 and the first control port 46. The third valve 58 of the first IMV 40 is opened and the fluid from the rod end chamber 24 of actuator 20 can exit to the reservoir through the third valve 58. In this case, the first valve 54 of the first IMV 40 should be closed so that the pressurized fluid from the pump 12 does not flow through the first valve 54.

The actuation direction of the first actuator 20 may be reversed by opening the first valve 54 and closing the third valve 58 of the first IMV 40, and opening the third valve 90 and closing the first valve 86 of the second IMV 72. The pressurized fluid from the pump 12 will flow through the first valve 54 of the first IMV 40 to the rod end chamber 24 of the first actuator 20, and the piston 26 and the piston rod 28 will move in the downward direction according to the orientation of FIG. 1. The fluid in the head end chamber 22 flows to the reservoir 14 through the third valve 90 of the second IMV 72.

Similarly, the second valve 56 of the first IMV 40 can be opened to allow fluid flow through the second valve 56 to the head end chamber 32 of the second actuator 30 to move the piston 36 and the piston rod 38. Simultaneously, the fluid from the rod end chamber 34 of the second actuator 30 flows via the conduit 84 to the second IMV 72. The fourth valve 92 should be open to discharge the fluid from the rod end chamber 34 to the reservoir 14. During this operation, the fourth valve 60 of the first IMV 40 and the second valve 88 of the second IMV 72 should be closed. To reverse the direction of the second actuator 30, the second valve 88 of the second IMV 72 and the fourth valve 60 of the first IMV 40 should be opened, and the first valve 56 and the fourth valve 92 of the second IMV 72 should be closed. The first and second double-acting actuators 20, 30 are operated and controlled independently as described above.

The operation of the fluid control system 10 in the regenerative function mode will now described. This regenerative function mode is often referred to as "Chicago Dump."

In the regenerative function mode, the proportional valve 106 of either the first check control mechanism 104 for the first IMV 40 or the second check control mechanism 105 for the second IMV 72 is closed. When the proportional valve 106 of the check control mechanism 104 is closed, the main check valve 70 is held in the closed position to block the fluid from the pump 12 from reaching the first outlet port 117 despite the fluid pressure from the pump 12. Thus, the pressurized fluid from the pump 12 does not reach any of the independently controlled valves of the first IMV 40.

When the proportional valve 106 of the check control mechanism 105 for the second IMV 72 is open, the main check valve 70 allows the pressurized fluid from the pump 12 to flow to the first and second valves 94, 96 of the second IMV 72. When the first valve 86 is opened, the fluid from the pump 12 flows through the first valve 86 into the head end chamber 22 of the first actuator 20 via the conduit 82. The fluid in the rod end chamber 24 flows out to the first IMV 40 via the conduit 50. In the regenerative function mode, the third and fourth valves 58, 60 of the first IMV 40 should be closed and the first and second valves 54, 56 should be opened so that fluid from the rod end chamber 24 of the first actuator 20 flows into the head end chamber 32 of the second actuator 30 via the first and second valves 54, 56. Because the main check valve 70 is held in the closed position, the regenerative fluid flow is not disturbed by the pressured flow from the pump 12 to the first IMV 40, and the regenerative flow passes through the first IMV 40. This regenerative flow to the head end chamber 32 acts to extend the piston rod 38. At the same time, the fluid in the rod end chamber 34 of the second actuator 30 flows out to the second IMV 72 via the conduit 84. The second valve 88 should be closed and the fourth valve 92 should be open so that the fluid can be discharged to the reservoir 14 and the pressurized fluid from the pump 12 does not enter through the second valve 88. In this configuration, the second actuator 30 is operated under lower pressure than the first actuator 20.

The actuation direction of the actuators 20, 30 can be reversed by closing the first and fourth valves 86, 92 of the second IMV and opening the second and third valves 88, 90. In this case, the rod end chamber 34 of the second actuator 30 is operated under higher fluid pressure than the rod end chamber 24 of the first actuator 20.

Alternatively, the proportional valve 106 of the first check control mechanism 104 may be opened and the proportional valve 106 of the second check control mechanism 105 may be closed. When the proportional valve 106 of the check control mechanism 105 for the second IMV 72 is closed, the main check valve 70 is held in the closed position and the fluid from the pump 12 is prevented from reaching any one of the independently controlled valves of the second IMV 72. This allows the rod end chamber 24 of the first actuator 20 or the head end chamber 32 of the second actuator 30 to operate under higher fluid pressure than the rod end chamber 34 of the second actuator 30 or the head end chamber 22 of the first actuator 20, respectively.

Thus, the present invention provides a fluid control system to accurately control operation of multiple double-acting actuators in independent and regenerative modes. The fluid control system is advantageous in several respects, one being in that it can efficiently switch between the independent and regenerative function modes.

It will be apparent to those skilled in the art that various modifications and variations can be made in the electro-hydraulic pump control system of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fluid control system, comprising:

a first double-acting actuator;

a second double-acting actuator;

a first independent metering valve having:

an inlet port;

a first control port connected to the first double-acting actuator;

a second control port connected to the second double-acting actuator;

first and second independently operable valves disposed between the inlet port and the first and second control ports; and a first check control mechanism having a main check valve between the inlet port and the first and second independently operable valves, the first check control mechanism controlling the main check valve to allow the first and second actuators to operate in either an independent function mode or a regenerative function mode; and a second independent metering valve having:

an inlet port;

a first control port connected to the first double-acting actuator;

a second control port connected to the second double-acting actuator;

first and second independently operable valves disposed between the inlet port and the first and second control ports; and a main check valve disposed between the inlet port and the first and second independently operable valves.

2. The fluid control systems of claim 1, further including a pump in fluid communication with the inlet port of the first independent metering valve and the inlet port of the second independent metering valve, and wherein the first double-acting actuator includes a first head end chamber and a first rod end chamber, and the second double-acting actuator includes a second head end chamber and a second rod end chamber.

3. The fluid control system of claim 2, wherein the first and second control ports of the first independent metering valve are connected to the rod end chamber of the first double-acting actuator and the head end chamber of the second double-acting actuator, respectively, and the first and second control ports of the second independent metering valve are connected to the head end chamber of the first double-acting actuator and the rod end chamber of the second double-acting actuator, respectively.

4. The fluid control system of claim 3, wherein the main check valve of the first check control mechanism is opened for the independent function mode and closed for the regenerative function mode.

5. The fluid control system of claim 4, wherein, in the regenerative function mode, fluid in the rod end chamber of the first double-acting actuator flows toward the head end chamber of the second double-acting actuator or fluid in the head end chamber of the second double-acting actuator flows toward the rod end chamber of the first actuator.

6. The fluid control system of claim 5, wherein the head end chamber of the first double-acting actuator is operated under higher fluid pressure than the head end chamber of the second double-acting actuator, or the rod end chamber of the second double-acting actuator is operated under higher fluid pressure than the rod end chamber of the first double-acting actuator.

7. The fluid control system of claim 2, further including a second check control mechanism for controlling the main check valve of the second independent metering valve.

8. The fluid control system of claim 7, wherein, in the regenerative function mode, fluid in the rod end chamber of the second double-acting actuator flows toward the head end chamber of the first double-acting actuator or fluid in the head end chamber of the first double-acting actuator flows toward the rod end of the second double-acting actuator.

9. The fluid control system of claim 2, wherein the pump is connected to the inlet port of the first independent metering valve and the inlet port of the second independent metering valve in parallel.

10. The fluid control system of claim 1, wherein the first check control mechanism includes a first check valve, a second check valve, and a proportional valve, the proportional check valve being opened for the independent function mode and closed for the regenerative function mode.

11. The fluid control system of claim 10, wherein the main check valve includes a body and a valve element slidably disposed within the body, the first check valve and the second check valve being provided internal to the body.

12. The fluid control system of claim 10, wherein the main check valve includes a body and a valve element slidably disposed within the body, at least one of the first check valve and the second check valve being provided external to the body.

13. A method of controlling fluid flow to and from first and second double-acting actuators in an independent function mode and a regenerative function mode, comprising:

providing a first independent metering valve having a first check control mechanism in fluid communication with the first and second double-acting actuators;

providing a second independent metering valve having a main check valve in fluid communication with the first and second double-acting actuator; and operating the first check control mechanism to allow the first and second actuators to selectively operate in independent and regenerative function modes.

14. The method of claim 13, wherein the first control check mechanism has a main check valve, and the main check valve is opened for the independent function mode and closed for the regenerative function mode.

15. The method of claim 13, wherein the second independent metering valve is provided with a second check control mechanism, and the main check valve of the second independent metering valve is opened for the independent function mode and closed for the regenerative function mode.

* * * * *